US005421551A

United States Patent [19]

LeClaire

[11] Patent Number: 5,421,551

[45] Date of Patent: Jun. 6, 1995

[54] ADJUSTABLE CURTAIN ROD

[75] Inventor: John W. LeClaire, Brookfield, Wis.

[73] Assignee: Springs Window Fashions Division, Inc., Middleton, Wis.

[21] Appl. No.: 229,183

[22] Filed: Apr. 18, 1994

[51] Int. Cl.[6] ..... A47H 1/00

[52] U.S. Cl. ..... 248/257; 248/265

[58] Field of Search ..... 248/257, 251, 254, 255, 248/259, 260, 261, 262, 263, 265; 211/105.2, 105.3; 160/330, 902

[56] References Cited

U.S. PATENT DOCUMENTS 4,352,433 10/1982 Ford ..... 211/105.1
4,824,062 4/1989 Wagner ..... 248/265
5,143,336 9/1992 McMichael ..... 248/265

*Primary Examiner*—Leslie A. Braun
*Assistant Examiner*—Anita M. King
*Attorney, Agent, or Firm*—Vernon J. Pillote

[57] ABSTRACT

An adjustable curtain rod mounting bracket comprising: a wall bracket member and a rod bracket member which are frangibly interconnected to facilitate packaging and assembly. The wall bracket member has wall attachment flange at the rear end on a panel portion and the rod bracket member has a rod support flange at the forward end of a panel portion, and the panel portions of the bracket members are disposed in end-to-end relation with the forward end of the panel portion of the wall bracket member integrally joined along a break-away line of weakness to the rear end of the panel portion of the rod bracket member. The panel portions are separable by hand bending the panels relative to each other in a direction crosswise of the break-away line and upper and lower guide flanges are provided at one side of one of the panel portions for guidably supporting the other of the panel portions after the panel portions have been separated along the break-away line to adjust the spacing between the wall attachment flange and the rod support flange and a latch and detent arrangement is provided for releasably retaining the bracket members in different adjusted positions.

4 Claims, 2 Drawing Sheets

FIG. 1
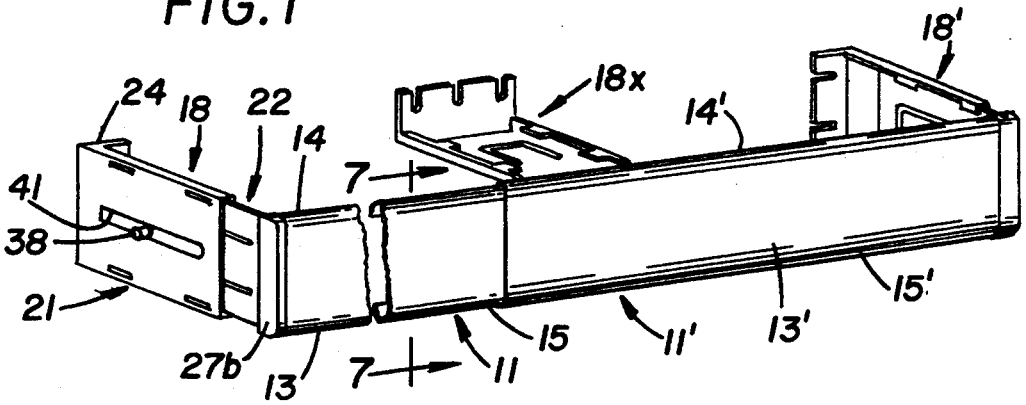
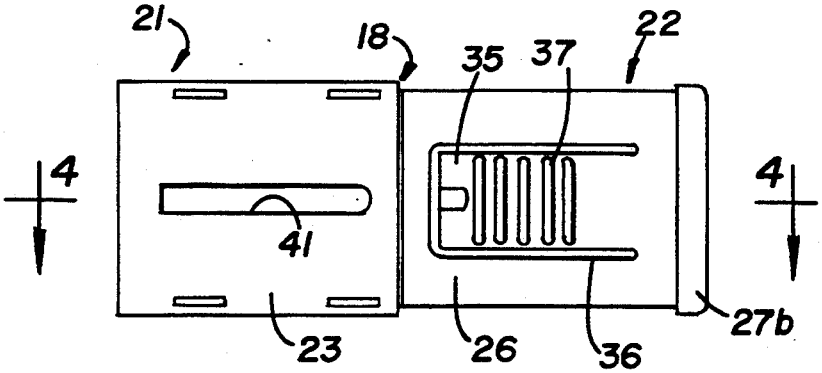
FIG. 2
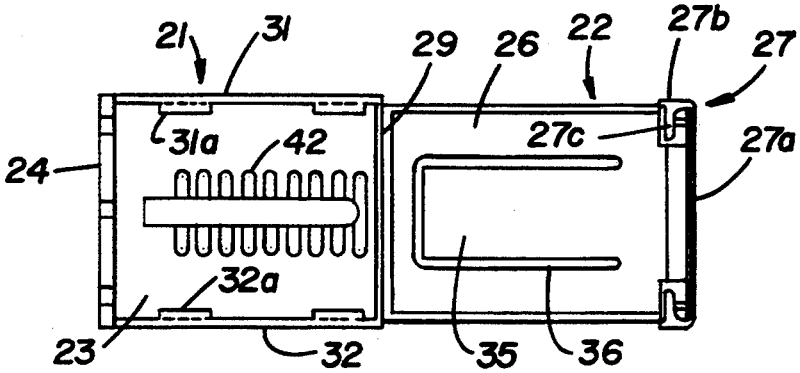
FIG. 3
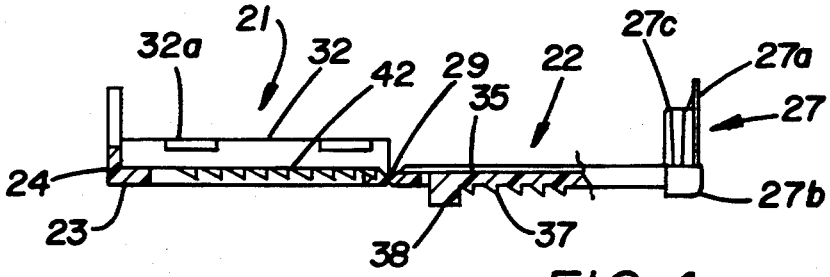
FIG. 4

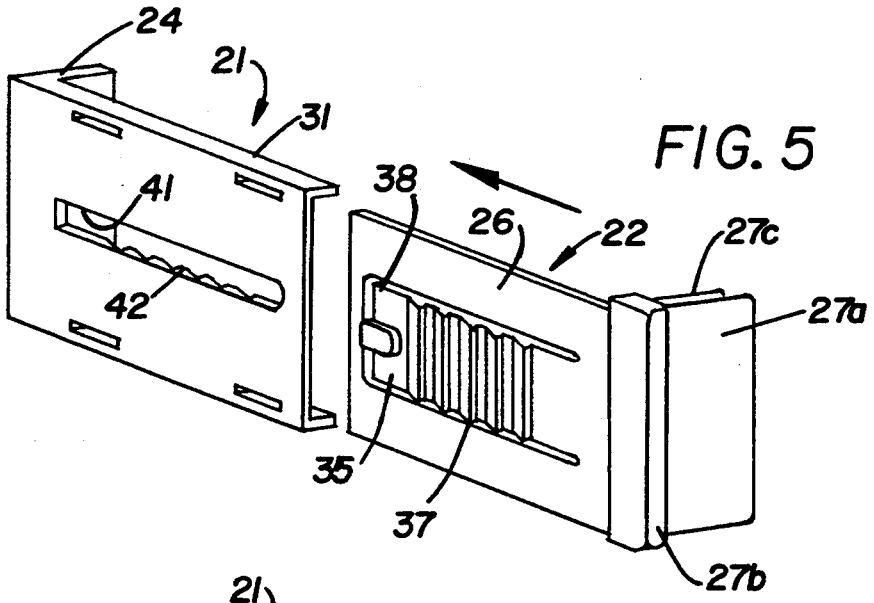
FIG. 5
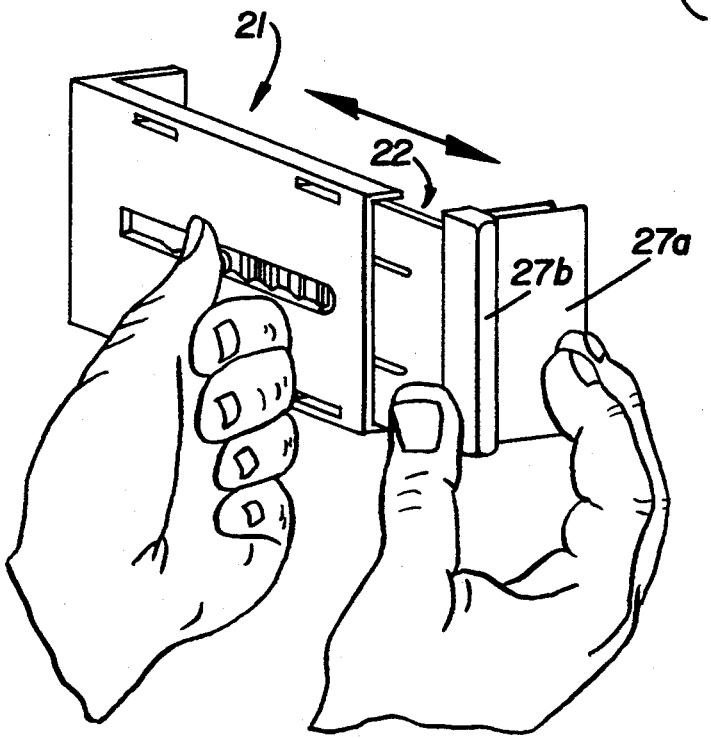
FIG. 6
FIG. 7
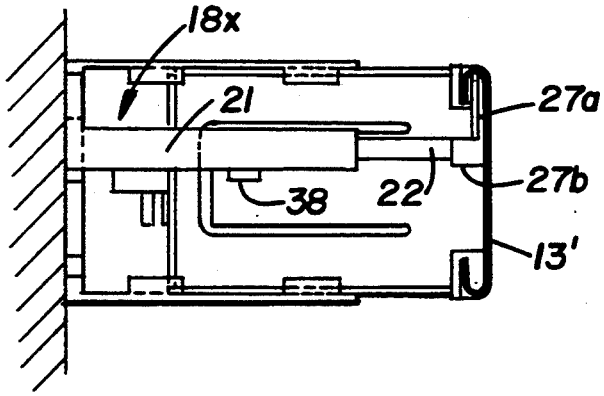

ADJUSTABLE CURTAIN ROD

BACKGROUND OF THE INVENTION

Adjustable curtain rods have heretofore been made, for example as disclosed in U.S. Pat. Nos. 4,352,433; 4,824,062 and 5,143,366, with telescopically adjustable inner and outer curtain rod sections to accommodate windows of different width, and with rod end brackets having telescopically adjustable members to adjust the spacing of the curtain rod from a wall. The telescopically adjustable inner and outer curtain rod sections have a similar cross-sectional shape but differ somewhat in size, and at least the rod engaging portions of the left and right end brackets are usually made of slightly different size and/or shape to accommodate the respective inner and outer rod sections.

Packaging of a number of different size parts required for the different end brackets not only increases the likelihood of errors in selecting and packaging the proper number and size of each of the different parts required for a curtain rod assembly, but also increases the likelihood of confusion of the installer when mounting the wall brackets and assembling the different rod end brackets on the wall brackets.

SUMMARY OF THE INVENTION

It is an object of the present invention to simplify packaging and installation of adjustable curtain rod mounting brackets, by frangibly interconnecting the rod bracket and associated wall bracket of each mounting bracket to thereby reduce the number of separate parts which must be handled in packaging and to facilitate subsequent assembly of the rod end brackets on the appropriate wall bracket at the time of installation.

Accordingly, each rod mounting bracket is formed in one piece with a wall bracket member having a panel portion and wall attachment means at the rear end of the panel portion and a rod bracket member having a panel portion and rod support means at a forward end of the panel portion. The rod support means of one mounting bracket is sized and configured to engage and support an end of an inner rod section and the rod engaging portion on the other rod mounting bracket is sized and configured to engage an end of an outer rod section. The wall bracket member and rod bracket member are formed of a synthetic resin material with the panel portions of each mounting bracket disposed in end-to-end relation and with the forward end of the panel portion of the wall bracket member integrally joined along a break-away line of weakness to the rear end of the panel portion of the rod bracket member, the panel portions being separable by hand bending. Flange means are provided on one side of one of the panel portions for guidably supporting the other of the panel portions after the panels have been separated along the break-line to adjust the spacing between the wall attachment means and the rod support means, and means are provided for releasably retaining the panels in different adjusted positions.

BRIEF DESCRIPTION OF THE DRAWINGS

FIG. 1 is a perspective view of a curtain rod and mounting bracket assembly embodying the present invention;

FIG. 2 is a side elevational view of one side of the rod mounting bracket;

FIG. 3 is a side elevational view of the side of the rod mounting bracket opposite that shown in FIG. 2;

FIG. 4 is a horizontal sectional view taken on the plane 4—4 of FIG. 2;

FIG. 5 is a perspective view illustrating assembly of the rod bracket member on a wall bracket member;

FIG. 6 is a perspective view illustrating adjustment of the rod bracket member on the wall bracket member; and FIG. 7 is a vertical sectional view taken on the plane 7—7 of FIG. 1 illustrating use of one of the mounting brackets for an intermediate support of the curtain rod.

DETAILED DESCRIPTION

The present invention relates generally to adjustable curtain rod and bracket assembly and particularly to a wide faced type rod and end bracket assembly for supporting curtains, draperies, valances and the like. The curtain rod includes telescopically adjustable inner and outer curtain rod members 11 and 11' to enable adjustment of the overall length of the curtain rod. The inner and outer curtain rod members are of like construction and respectively have generally flat front wall 13, 13' and upper and lower U-shaped flanges 14, 14' and 15, 15'. The rod members can be formed of sheet metal or a synthetic resin material, for example extruded polyvinyl chloride. Telescopically adjustable curtain rod members are supported adjacent ends by left and right mounting brackets designated 18, 18', and herein sometimes referred to as the inner rod mounting bracket and the outer rod mounting bracket. The inner and outer rod mounting brackets are generally mirror images of each other with small differences in size in at least the rod engaging portions to accommodate the difference in cross-sectional size of the inner and outer curtain rod members, and like numerals are used to designate corresponding parts.

The rod mounting brackets each include a wall bracket member 21 and a rod bracket member 22. The wall bracket member 21 includes an upright panel portion 23 and a wall attachment means such as a flange 24 at a rear end thereof. The rod mounting bracket includes a panel portion 26 having a rod engaging portion 27 at a forward end thereof shaped to engage and support an end of an associated one of the inner and outer curtain rod sections 11, 11'.

The wall bracket member and rod bracket member are formed of a synthetic resin material such as high impact polystyrene and which is sufficiently rigid as to be normally shape sustaining. In accordance with the present invention, the rod bracket member and wall bracket member are molded in one piece with the panel portions of the bracket members disposed in end-to-end relation and with the forward end of the panel portion of the wall bracket member integrally joined along a break-away line of weakness 29 to the rear end of the panel portion of the rod bracket member. As best shown in FIG. 4, the line of weakness is conveniently formed by a V-shaped notch in one or both faces at the juncture of the panels 23 and 26, the depth of the notch being selected so that the panels will remain integrally joined under normal handling but such that the panels can be separated by hand bending of the panels relative to each other in a direction crosswise of the break-line. The panel portion on one of the bracket members has flanges for guidably receiving the panel portion of the other of the bracket members when the bracket members have been separated. In the preferred embodiment illustrated, the wall bracket member 23 has upper and lower laterally extending flanges 31 and 32 extending laterally from an inner side face thereof with flange portions 31*a* and 32*a* spaced from the inner side of panel 23 to guidably support the panel portion of the rod bracket member at the inner side of the wall bracket member. As will be seen from FIG. 4, the V-shaped groove at the adjacent ends of the panel portions 23 and 26, provides a beveled edge at the rear end of the panel portion of the rod bracket member to aid in guiding the panel portion of the rod bracket member between the panel portion and flanges on the wall bracket member. The broken edges formed when the panels are separated, do not interfere with assembly or adjustment of the bracket members.

An improved arrangement is provided for adjustably retaining the rod bracket member in adjusted position on the wall bracket member. As shown in FIGS. 2 and 3, a resilient latch finger 35 is formed in the panel portion 26 of the rod bracket member by a U-shaped slot 36 of generally U-shaped configuration. The latch finger is formed with one or more teeth 37 on an outer side face thereof and a push button 38 adjacent the distal end of the finger 35. The panel 23 of the rod bracket member is formed with an elongated slot 41 for receiving the push button 38, and a row of teeth 42 herein sometimes referred to as detent means, at an inner side of the panel 23. The teeth 37 on the finger 35 are adapted to inter engage with the teeth 42 on the panel 23 to retain the rod bracket member in adjusted position on the wall bracket member and, preferably, the teeth 37 and 42 are beveled or inclined as shown in FIG. 4 in a direction such as to allow the teeth on the finger to ratchet over the teeth 42 on the wall bracket member when the rod bracket member is pushed inwardly. The push button 38 extends through the slot 41 and can be depressed from a position at the outer side of the wall bracket member for adjustment of the rod bracket member. After the rod bracket member has been assembled on the wall bracket member, push button 38 is operative to engage the forward end of the slot 41 to prevent accidental detachment of the rod bracket member from the associated wall bracket member.

The rod mounting means 27 on the rod bracket member includes a panel 27*a* that extends from the forward end of the panel 26, and an integral corner piece 27*b* at the juncture of the panel 26 and the panel 27*a*. The corner piece is arranged to abut against an end of the associated rod section 11 or 11', and is also arranged to abut against the forward end of the associated wall bracket member 21 and continue the lines of the rod section around the corner. Upper and lower flanges 27*c* are provided at the rear side of panel 27*a* and arranged to engage the rear flange on an associated one of the rod sections. As will be understood, the height of the flange portion 27*a* and the spacing of the flanges 27*c* from the flange portion 27*a* on the mounting bracket 18 for the inner rod section will be slightly different from that on the mounting bracket 18' for the outer rod section 15' to accommodate the differences in the cross-section of the inner and outer curtain rod sections.

The mounting brackets are such that either an inner or outer mounting bracket can be used as an adjustable intermediate rod support. As shown in FIGS. 1 and 7, a third mounting bracket designated 18*x* the same as either an inner or outer mounting bracket, can be mounted in an inverted position with the flange 27*a* extending upwardly to engage the upper U-shaped flange on the curtain rod member. When in this position, the push button 38 is accessible from the underside of the wall bracket to facilitate adjustment of the intermediate mounting bracket.

The embodiments of the invention in which an exclusive property or privilege is claimed are defined as follows:

1. A curtain rod mounting bracket of synthetic resin material comprising: a wall bracket member and a rod bracket member, each bracket member including a panel portion having upper and lower edges and forward and rear ends, the panel portion of the wall bracket member having wall attachment means at the rear end thereof and the panel portion of the rod bracket member having rod support means at the forward end thereof and the panel portions of the mounting bracket being disposed in end-to-end relation with the forward end of the panel portion of the wall bracket member integrally joined along a break-away line of weakness to the rear end of the panel portion of the rod bracket member, the panel portions being separable by hand bending the panels relative to each other in a direction crosswise of the break-away line, upper and lower flange means at one side of one of the panel portions for guidably supporting the other of the panel portions after the panel portions have been separated along the breakaway line to adjust the spacing between the wall attachment means and the rod support means, and means for releasably retaining the bracket members in different adjusted positions.

2. A curtain rod mounting bracket according to claim 1 wherein the panel portion associated with the wall bracket member has a slot paralleling the upper and lower edges thereof, and said means for retaining the panels in adjusted positions including a resilient latch finger on the panel portion associated with the rod bracket member and normally biased into engagement with the panel portion associated with the wall bracket member, the latch finger having a latch release button extending through said slot.

3. A curtain rod mounting bracket of synthetic resin material comprising: a wall bracket member and a rod bracket member, each bracket member including a panel portion having upper and lower edges and forward and rear ends, the panel portion of the wall bracket member having integral wall attachment means at the rear end thereof and the panel portion of the rod bracket member having integral rod support means extending laterally from one side at the forward end thereof, the panel portions of the mounting bracket being disposed in end-to-end relation with the forward end of the panel portion of the wall bracket member integrally joined along a break-away line of weakness to the rear end of the panel portion of the rod bracket member, the panels being separable by hand bending the panels relative to each other in a direction crosswise of the break-away line, upper and lower flange means at one side of the panel portion of the wall bracket member for guidably supporting the panel portion of the rod bracket member at said one side of the wall bracket member after the panel portions have been separated along the break-line, the panel portion of the wall bracket member having a slot therethrough paralleling the upper and lower flange means and detent means at said one side thereof, the panel portion of the rod bracket member having a resilient latch finger formed integrally therewith and at least one latch tooth on the finger engageable with the detent means, the finger having a latch release button extending through the slot in the panel portion of the wall bracket member.

4. A curtain rod and rod mounting assembly inner and outer telescopically adjustable rod sections each having a front wall and upper and lower U-shaped flanges extending lengthwise along a rear side thereof, first and second brackets for respectively supporting the inner and outer rod sections, the first and second brackets each comprising a wall bracket member and a rod bracket member, each bracket member including a panel portion having upper and lower edges and forward and rear ends, the panel portion of each wall bracket member having integral wall attachment means at a rear end thereof and the panel portion of the rod bracket member of the first bracket having an integral rod support means at the forward end thereof for the inner rod section and the panel portion of the rod bracket member of the second bracket having an integral rod support means at the forward end thereof for the outer rod section, the panel portions of each mounting bracket being disposed in end-to-end relation with the forward end of the panel portion of the wall bracket member integrally joined along a break-away line of weakness to the rear end of the panel portion of the rod bracket member, the panels being separable by hand bending the panels relative to each other in a direction crosswise of the break-away line, upper and lower flange means on one side of the panel portion of each wall bracket member for guidably supporting the panel portion of the associated rod bracket member at said one side of the wall bracket member after the panel portions have been separated along the break-line, the panel portion of each wall bracket member having a slot therethrough paralleling the upper and lower flange means and detent means at said one side thereof, the panel portion of each rod bracket member having a resilient latch finger formed integrally therewith and at least one latch tooth on the finger engageable with the detent means, each finger having a latch release button extending through the slot in the panel portion of the associated wall bracket member.

* * * * *